US005944304A

United States Patent [19]

Branecky et al.

[11] Patent Number: 5,944,304

[45] Date of Patent: Aug. 31, 1999

[54] ENVELOPE FEEDING AND STAGING MACHINE FOR HIGH SPEED INSERTING APPARATUS

[75] Inventors: George Branecky, Bethel; Edward M. Ifkovits, Jr., New Fairfield; Michael R. Ifkovits, Danbury; Karel J. Janatka, Southbury, all of Conn.; Douglas P. Sprenger, Dover Plains, N.Y.; Shahzad H. Malick, Fairfield, Conn.

[73] Assignee: Pitney Bowes Inc., Stamford, Conn.

[21] Appl. No.: 08/733,459

[22] Filed: Oct. 18, 1996

[51] Int. Cl.[6] ..... B65H 5/00; B65H 7/02; B65H 5/12; B65H 33/04

[52] U.S. Cl. ..... 271/2; 270/58.06; 271/10.03; 271/10.11; 271/259; 271/266

[58] Field of Search ..... 270/58.06; 271/10.01, 271/10.02, 10.03, 10.09, 10.11, 10.13, 258.01, 259, 265.01, 265.02, 266, 270

[56] References Cited

U.S. PATENT DOCUMENTS

| | | | |
|---|---|---|---|
| 2,030,656 | 2/1936 | Royster | 270/58.06 |
| 2,625,392 | 1/1953 | Morrison | 270/58.06 |
| 2,657,043 | 10/1953 | Colby | 270/58.06 |
| 4,362,100 | 12/1982 | Wu et al. | 271/258.01 |
| 4,451,027 | 5/1984 | Alper | 271/259 |
| 4,972,655 | 11/1990 | Ogawa | 270/58.06 |
| 4,987,547 | 1/1991 | Rabindran et al. | 270/58.06 |
| 5,029,832 | 7/1991 | Orsinger et al. | 270/58.06 |
| 5,154,412 | 10/1992 | Iseda | 271/270 |
| 5,423,527 | 6/1995 | Tranquilla | 271/259 |
| 5,461,468 | 10/1995 | Dempsey et al. | 271/259 |

*Primary Examiner*—William E. Terrell
*Assistant Examiner*—Joe Dillon, Jr.
*Attorney, Agent, or Firm*—Christopher J. Capelli; Melvin J. Scolnick

[57] ABSTRACT

An separating and staging machine is disclosed which is used in conjunction with high speed document processing apparatus in which a succession of collations of insert material moving along an insert material feed path to an insert location are inserted into envelopes fed to the insert location. The machine of the present invention feeds envelopes from a storage hopper to a feed path which is long enough to accommodate a plurality of staging locations at which individual envelopes are maintained until one is fed to the insert location, after which the envelopes at each staging location are advanced to the next staging location, and a new envelope is fed from the storage hopper to the first of the staging locations. With this arrangement the distance between successive envelopes moving through the staging locations is approximately equal to the distance between successive collations moving along the insert material feed path, thereby increasing the rate at which envelopes can be fed to the insert location.

10 Claims, 4 Drawing Sheets

10
12
14
E
E1
E2
E3
E4
F
36
40
42
44
46
48
50
52
54
56
58
60
62
68
70
72
74
76
78
80
82
86
88
89
90
92
94
96
98
100
102
104
106
108
112
114

E
F
E1
E2
E3
E'
10
12
14
16
18
20
22
24
25
26
28
30
32
34
36
40
41
42
44
46
48
50
52
54
56
58
59
60
62
64
66
68
69
70
72
74
76
78
79
80
82
83
84
85
86
88
89
90
92
94
96
98
100
102
104
106
108
112
113
114
116
118
120
122
123
124
126
128
130
132
134
136
137
138
142
144
146
148
150
3

ENVELOPE FEEDING AND STAGING MACHINE FOR HIGH SPEED INSERTING APPARATUS

BACKGROUND OF THE INVENTION

This invention relates generally to the field of envelope feeding apparatus, and more particularly to an apparatus for feeding envelopes to the inserting station of an inserting machine at a high through put rate.

Envelope inserting machines have long been well known and are utilized in a large variety of document processing applications which involve inserting one or more items into an envelope for further handling, such as mailing or other forms of document processing. One particular application where these machines are used involves large high speed multi-function processing apparatus which store a plurality of different types of insert material in individual feeding devices which are added to a basic document that is traveling along an elongate insert material feed path, at the end of which the basic document and the insert materials are formed into a collation which is then inserted into an envelope, all in a continuous operation. Typical examples of applications for these machines are mass mailers such as banks, credit card operations, and telephone and other public utility companies that mail monthly statements or bills to customers, book clubs, catalog mail order companies and other business operations in which certain material is mailed to tens or perhaps hundreds of thousands of customers each month.

These examples involve a typical document handling process in which basic documents, such as monthly invoices, statements, bills, etc., to customers, are computer printed on forms passed through a high speed computer printer in continuous web form, and are then fed through a suitable separating machine which separates the individual invoices from the web, and feeds them into the feed path of a collating machine. The collating machine typically includes a plurality of individual feeding devices which feed any desired number of other documents, such as advertising material, services information brochures, announcements of forthcoming services, sweepstakes entries, etc., into the insert material feed path to add these materials to the basic documents as they travel along the feed path of the collating machine. All of the collated material may be passed through an accumulator or other device that arranges the material in a precisely aligned packet, which is then fed to an inserting machine where the packet is inserted into an envelope which is suitably held at an inserting station. After the packet of documents is inserted into the envelope, it is typically fed through a machine which moistens the envelope flap, turns it 180° and presses it against the back of the envelope to seal it thereto. The now closed and sealed envelope is then typically fed either through a postage metering machine for printing a postage indicia on the envelope or it may be fed directly to a suitable stacking device for further processing.

The problem that arises is that the insert material can be dispensed by the individual feeders and injected into the insert material feed path with the basic document at a much faster rate of speed than that at which individual envelopes can be fed from the envelope storage and feeding device and fed to the location in the inserting machine where the collation of basic document and insert material is inserted into the envelope. The principal reason for this is that in the traditional form of envelope inserting machines, the envelopes are stored in the hopper of a storage and feeding component that is disposed generally above and either to the left or right of the insert location of the inserting apparatus. Thus, there is an envelope feed path for the envelopes between the storage hopper and the insert location that is of some substantial length, in order to provide the room necessary for an envelope flapping device which opens the flaps of the envelopes as they are fed from the storage position to the insert location. In all typical high speed collating and inserting apparatus, the length of this envelope feed path is considerably longer than the typical spacing between successive collations of insert material moving along the insert material feed path because it is not possible to move envelopes from the storage hopper at the same rate as that at which insert material can be moved along the insert material feed path to the insert location. Therefore, the through put capacity of the entire document processing apparatus is limited by the rate at which envelopes can be delivered to the insert location. Further, it is typically not possible to shorten the supplemental feed path because of the space required for the envelope flapping device.

Another factor limiting the rate of envelope feeding is that there is a maximum limit to the linear velocity at which envelopes can be fed along the supplemental feed path from the supply hopper to the insert location, above which jams tend to occur due to the physical nature of envelopes and the fact that the flaps have to be opened, and this maximum limit is typically well below the linear velocity at which insert material can be injected into and fed along the primary feed path. Thus, merely increasing the speed of operation of the envelope storing and separating machine is not a viable solution.

Thus, there is a need for an effective alternative arrangement for feeding envelopes from a storage hopper to the insert location in an envelope inserting machine in which the envelopes can be moved from the storage hopper along the envelope feed path and positioned at the insert location at the same rate at which insert material can be moved along the insert material feed path and positioned at the insert location.

BRIEF SUMMARY OF THE INVENTION

The present invention substantially obviates, if not entirely eliminates, the above shortcomings and other disadvantages of current envelope storing and separating machines for high speed document processing apparatus by providing an envelope separating and staging machine for use in such apparatus in which a succession of collations of insert material moving along an insert material feed path to an insert location are inserted into envelopes fed to the insert location. In this environment, the envelope separating and staging machine of the present invention comprises envelope storing and separating means disposed in spaced operative relationship with the insert location of an inserting machine, and means defining an envelope feed path extending from said storing and separating means to the insert location, the envelope feed path being of sufficient length between the storing and separating means and the insert location to provide a plurality of closely spaced apart envelope staging locations. Means are provided for feeding envelopes successively through the staging locations and for temporarily holding an envelope at each of the plurality of staging locations. There is a control means for controlling the operation of the storing and separating means and the feeding means for moving the envelopes through the plurality of staging locations along the feed path to the insert location in timed synchronism with the arrival of the collations of insert material at the insert location. Thus, with this arrangement, the distance between successive envelopes moving through the plurality of staging locations along the feed path to the insert location is approximately equal to the distance between successive collations moving along the insert material feed path, thereby increasing the rate at which envelopes can be fed to the insert location.

In some of its more limited aspects, the control means comprises detecting means disposed in each of the staging locations for detecting the presence of the trailing edges of envelopes moving out of each of the staging locations for causing the feeding means to feed an envelope from a preceding staging location to a succeeding staging location when the envelope in the succeeding staging location has been moved substantially out of the succeeding staging location. The detecting means also detects the presence of the leading edges of envelopes moving into each of the staging locations for controlling the position in each of the staging locations at which the envelopes come to rest.

The control means further includes a microprocessor having mean responsive to signals from the detecting means for actuating the feeding means to cause it to feed envelopes from one staging location to the next in response to the detecting means detecting the trailing edges of the envelopes, and for causing the feeding means to stop the movement of the envelopes in the staging locations in response to the detecting means detecting the leading edges of said envelopes.

The feeding means comprises a plurality of individual feeding assemblies disposed in spaced apart relationship along the feed path which define the staging locations between adjacent feeding assemblies. There is a continuously operating drive system for both the storing and separating means and the individual feeding assemblies, and a plurality of brake/clutch assemblies, under the control of the microprocessor, alternately engage the clutch component or the brake component of each of the clutch/brake assemblies to control the storing and separating means and the individual feeding assemblies to move the envelopes in each of the staging locations individually so that they are fed from one staging location to another in properly timed relationship and also properly located within each of the staging locations.

Having briefly described the general nature of the present invention, it is a principal object thereof to provide an envelope separating and staging machine for use in a high speed document processing apparatus in which a plurality of envelopes are successively fed along an elongate envelope feed path to the insert location of an inserting machine at the same rate at which insert material is fed to the insert location by the document processing apparatus.

Another object of the present invention is to provide an envelope separating and staging machine as described in which the movement of each of the envelopes being fed to the insert location is individually controlled both as to time and extent of movement so as to cause successive envelopes to arrive at the insert location in timed synchronism with the arrival of insert material at the insert location.

These and other objects of the present invention will become more apparent from an understanding of the following detailed description of a presently preferred mode of carrying out the invention when considered in conjunction with the accompanying drawings.

DETAILED DESCRIPTION OF THE INVENTION

Figure 1:
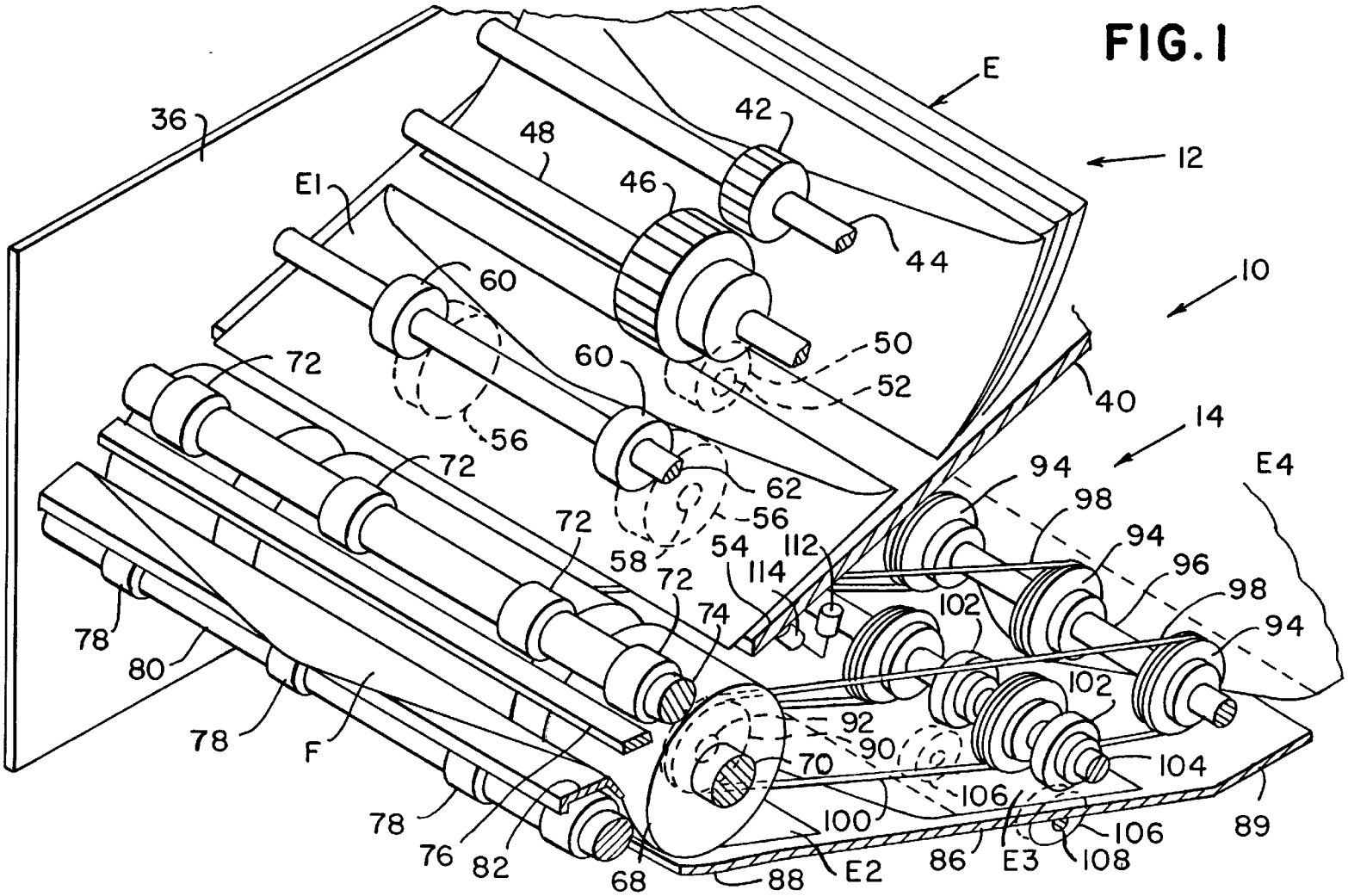
FIG. 1 is a perspective view of the envelope separating and staging machine of the present invention, also showing a fragmentary portion of the insert material feeding apparatus, with partial frame structure broken away to reveal interior detail.

Referring now to the drawings and particularly to FIG. 1 thereof, the envelope separating and staging mechanism of the present invention is generally indicated by the reference numeral 10, and comprises two major components, an envelope storing and separating component, indicated generally by the reference numeral 12, and an envelope staging component, indicated generally by the reference numeral 14. The reference numeral 16 (FIG. 2) indicates generally a fragmentary portion of a typical high speed document processing apparatus with which the envelope separating and staging mechanism 10 of the present invention is utilized. As will become more apparent from the following description, the envelope separating component 12 separates consecutive envelopes from a supply thereof and feeds them to the envelope staging component 14 in which they are temporarily held until they are moved forward in succession to the insert station of the document processing apparatus 16, at which insert material is inserted into the envelopes.

Figure 2:
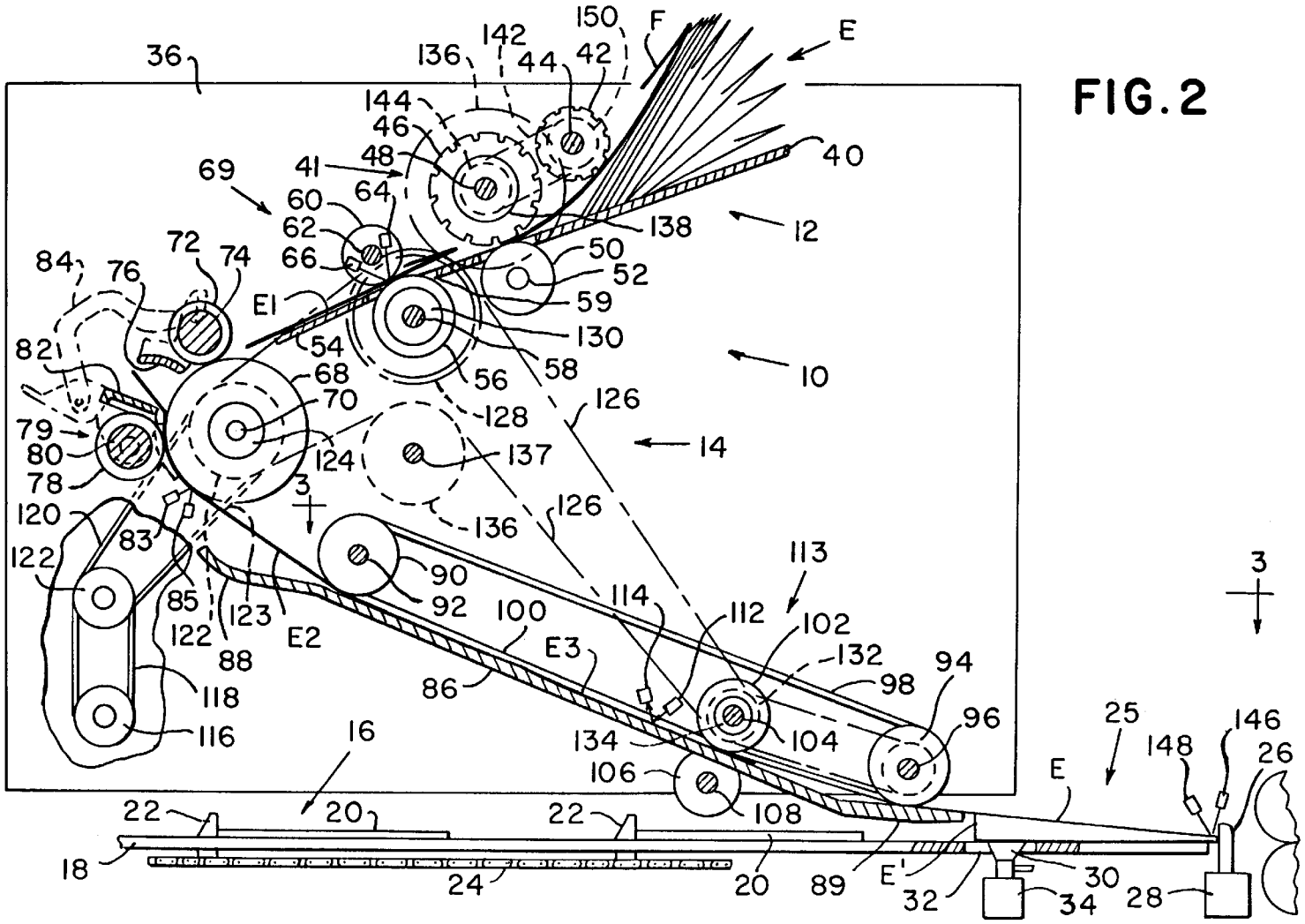
FIG. 2 is a side elevation of the apparatus shown in FIG. 1

The document processing apparatus 16 forms no part of the present invention and therefore is described in only so much detail as is necessary for an understanding of the present invention. Thus, with reference to FIG. 1, it will be seen that the apparatus 16 comprises an elongate frame 18 which defines an insert material feed path for collations 20 of insert material which have been previously assembled by well known feeding and collating devices that are not shown. A plurality of pusher members 22 are connected to an endless chain 24 and are moved along the frame 18 from left to right as seen in FIG. 2 so as to move the collations 20 of insert material along the feed path toward an insert location indicated generally by the reference numeral 25. An envelope E is shown at the insert location 25 with the throat E' of the envelope held open to receive a collation 20 of insert material. The envelope E is appropriately positioned at the insert location 25 by means of suitable stop members 26 which can be raised and lowered by a solenoid 28, or other suitable device. A plurality of vacuum heads 30 are positioned in juxtaposition with apertures 32 in the frame 18 so as to contact the rear surface of the envelope E when it is in the insert location 25 so as to open the throat E' to permit the collation 20 to enter in response to forward movement of the pusher member 22. The vacuum heads 30 are moved up and down by solenoids 34, or other suitable means, in much the same manner as the stop member 26, to ensure that they do not interfere with the next incoming envelope.

As best seen in FIG. 2, the envelope storing and separating component 12 is disposed in spaced operative relationship with the insert location 25, and comprises a pair of suitable side frame plates 36 which support in a suitable manner all of the parts hereinafter described. Thus, with reference to FIGS. 1 and 2, the component 12 includes a suitable supply hopper 40 which holds a stack of envelopes E in generally upright orientation, with the flaps F of the envelopes E uppermost and facing forward. A suitable separating device, indicated generally by the reference numeral 41, includes a notched rubber feed roller 42 mounted on a shaft 44 which bears against the lead envelope E in the stack, and when driven feeds the envelope E into the nip between another notched feed roller 46 mounted on a shaft 48 and a separating stone 50 which is fixedly mounted on a shaft 52. The feed roller 46 and the separating stone 50 cooperate in a manner well known in the art to prevent more than one envelope at a time from being fed from the stack.

The feed roller 46 feeds the envelope E along a suitable guide plate 54 also mounted between the side frame plates 36, although this guide plate may be formed as an extension of the bottom of the envelope hopper 40, and constitutes a transition point from the envelope storing and separating component 12 to the envelope staging component 14. Each staging component 14 includes a plurality of individual feeding assemblies 43, 69, and 113. Individual feeding assemblies 43, 69 and 113 further include a plurality of feed rollers 56 and a plurality of back up rollers 60 driven by a main drive system each of which are further described below. The envelope is fed into the nips of a plurality of feed rollers 56 mounted on a shaft 58 and projecting through apertures 59 in the guide plate 54, and a plurality of back up rollers 60 mounted on a shaft 62. The feed rollers 56 are driven by a main drive system fully described below.

As best seen in FIG. 2, a suitable detecting device, such as optical photo detector having a light emitter 64 and receptor 66, is positioned between a pair of the backup rollers 60 to recognize the arrival of the leading edge of the envelope E at the nip of the rollers 56 and 60, and thereafter to control the movement of the envelope E along the guide plate 54 until it reaches the first staging location indicated by the envelope labeled E1. The function and operation of the detecting device 64/66 in stopping the movement of the envelope at the position labeled E1, which is the first staging location, will be further explained in connection with the description of the control system for, and operation of, the separating and staging machine 10.

Another plurality of feed rollers 68 are mounted on a shaft 70 and another plurality of back up rollers 72 are mounted on a shaft 74, such that the nips of the rollers 68 and 72 are disposed so as to move the envelope E1 around the roller 68 to the position indicated by the envelope labeled E2, which is the second staging location. During this movement, the lead edge of the envelope passes through a typical flapping device which opens the flap of the envelope to expose the throat. The flapping device comprises a curved guide plate 76 which is pivotally mounted on the shaft 74 and normally lies contiguous with the periphery of the feed rollers 68 so as to guide the lead edge of the envelope around the feed rollers 68 and into the nips of the feed rollers 68 and another set of back up rollers 78 mounted on a shaft 80. A flapping bar 82 is also positioned adjacent the periphery of the feed rollers 68 and is pivotally mounted on the shaft 80 so as to normally be in a position in which the upper surface of the flapping bar 82 intercepts the lead point or edge, as the case may be, of the envelope flap F so as to separate the flap from the rear surface of the envelope and cause it to assume an open position. The curved guide plate 76 and the flapping bar 82 are connected by a suitable linkage arrangement 84 so that they pivot together when the lead edge of the envelope intercepts a portion (not shown) of the flapping bar 82 that lies in the path of movement of the envelope. The flapping mechanism is well known, and further details thereof are not a part of the present invention, and therefore need not be further described for a full understanding of the invention.

Another suitable detecting device, such as the optical emitter 83 and detector 85, is positioned adjacent the feed roller 68 just below the location of the backup rollers 78 to detect the movement of an envelope around the feed roller 68 and the flapping device just described, and thereafter to control the movement of the envelope E until it reaches the second staging location indicated by the envelope designated E2. Again, the function and operation of this detecting device 83/85 will be fully explained hereinbelow in connection with the description of the control system for the separating and staging machine 10.

The envelope staging component 14 also includes an elongate support plate 86 suitably supported between the side frame plates 36, the support plate 86 extending from a location adjacent to the nips of the feed rollers 68 and the back up rollers 78. The support plate 86 has a curved upper end 88 which intercepts the lead edge of the envelope as it approaches the second staging location indicated by the envelope E2, and guides the lead edge along the upper surface of the guide plate 86 until the envelope is fully disposed in the second staging location. The support plate 86 also has a lower terminal portion 89 which is disposed at a considerably small angle to the horizontal frame 18 of the inserting apparatus 16 than is the remainder of the support plate 86 to assist in guiding the envelope E onto the frame 18 in position to be intercepted by the stop members 26.

A plurality of pulleys 90 are mounted on a shaft 92 so as to be positioned adjacent the upper end of the support plate 86, and another plurality of pulleys 94 are mounted on a shaft 96 so as to be positioned adjacent the lower end of the support plate 86. An O-ring belt 98 extends around each set of pulleys 90 and 94, the lower runs 100 of the belts 98 being in contact with the upper surface of the guide plate 86.

A plurality of feed rollers 102 are mounted on a shaft 104 in overlying relationship with the support plate 86, and a corresponding plurality of back up rollers 106 are mounted on a shaft 108 beneath the support plate 86, the back rollers 106 projecting through suitable apertures (not shown) in the support plate 86 so as to contact the feed rollers 102.

As seen in both FIGS. 2 and 3, a third detecting device, again such as the light emitter 112 and receptor 114, are positioned along the support plate 86 adjacent to, but upstream from, the nips of the feed rollers 102 and back up rollers 106, again for a purpose that will be made clear in the description of the control system and the operation of the envelope separating and staging machine 10.

As briefly mentioned above, all of the feed rollers are driven from a common source of power through suitable moving and arresting means such as a clutch/brake assembly, which operation thereof is controlled a by a suitable microprocessor. Thus, with reference to FIG. 2, a motor 116 drives a belt 118 which drives another belt 120 through a suitable transfer pulley 122. The belt 120 drives a pulley 123 which is connected to the shaft 70 through a suitable clutch/brake assembly 124, so that when the clutch component of the assembly 124 is engaged, the brake component is released and drive is transferred to the shaft 70 and the feed rollers 68; and when the clutch component is disengaged, the brake is applied and the shaft 70 and the feed rollers 68 are held stationary. The clutch/brake assemblies are standard, commercially available components, well known in the art, and further description thereof is not deemed necessary.

The pulley 123 is a double pulley and drives another belt 126 which passes around another pulley 128 which is connected to the shaft 58 through another clutch/brake assembly 130. The clutch/brake assembly 130 operates in the same manner as the clutch/brake assembly 124 to transfer drive to the shaft 58 and feed rollers 56, or to maintain the shaft 58 and feed rollers 56 stationary.

The belt 126 also passes around a pulley 132 which is connected to the shaft 104 through still another clutch/brake assembly 134, which again operates in the same manner as that described above to transfer drive to the shaft 104 and the feed rollers 102, or to maintain them stationary, as the case may be. The belt 126 then passes around a tensioning roller 136 mounted on a shaft 137 and returns to the pulley 122.

As seen in FIG. 2, the feed roller 46 is conveniently driven by a friction roller 136 which is mounted on the shaft 48 and which is driven by another friction roller (not shown) mounted on the shaft 58 for continuous rotation with the pulley 128. Another clutch/brake assembly 138 controls the rotation of the shaft 48 and the feed roller 46 in the same manner as previously described for the other rollers controlled by clutch/brake assemblies. Finally, the feed roller 42 is driven by a belt 142 which passes around a pulley 144 on the shaft 48 and around another pulley 150 on the shaft 44.

Figure 4:
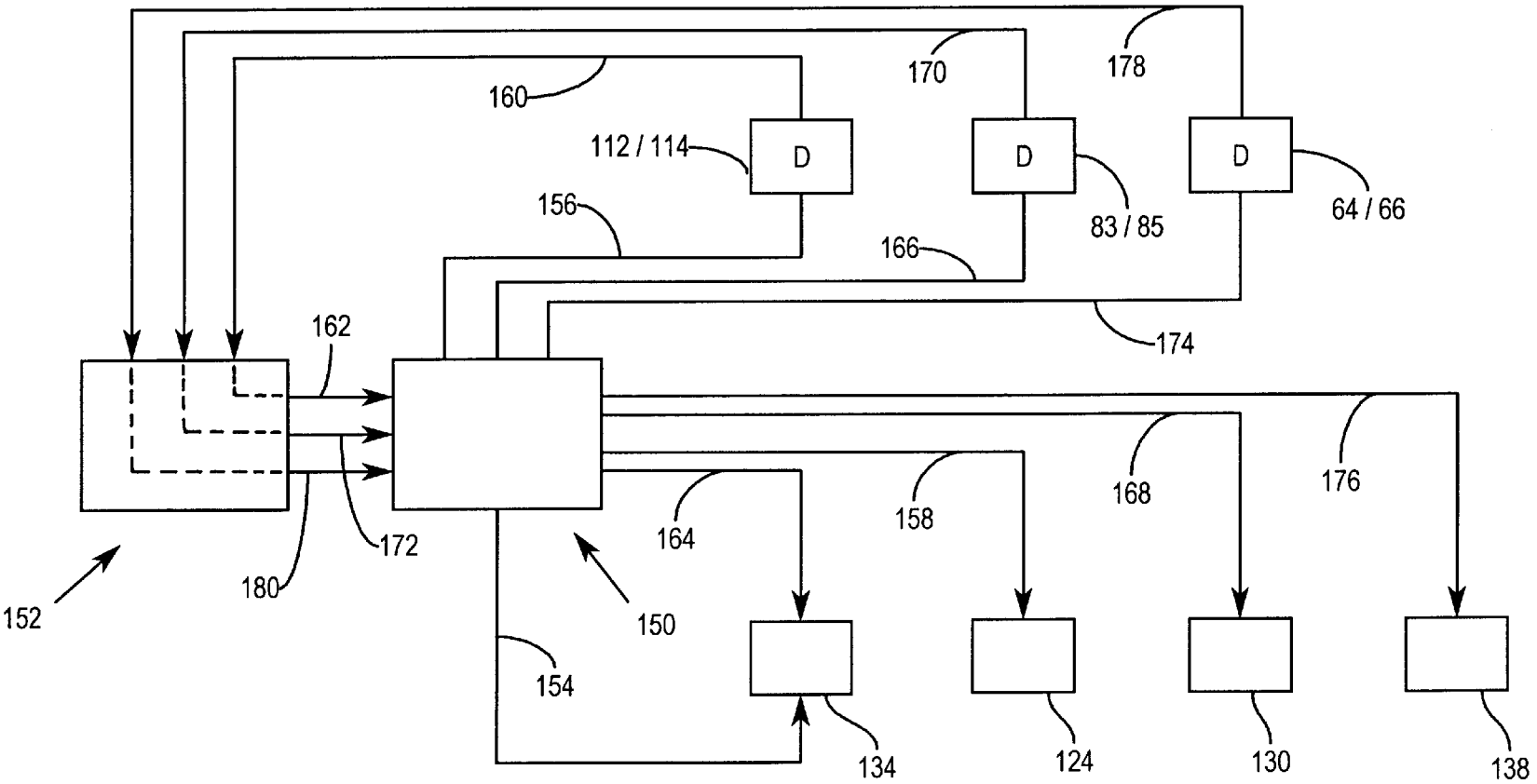
FIG. 4 is a schematic diagram of the control system for the envelope separating and staging machine of the present invention.

The control system for the envelope separating and staging machine 10, as well as the operation thereof, will now be described with reference to the schematic diagram shown in FIG. 4. It should be understood that all of the components of the control system are well known in the art, and therefore only so much of the control system as is necessary for a full understanding of the operation of the machine 10 is described herein.

The heart of the control system is a suitable microprocessor designated generally by the reference numeral 150, which controls not only the operation of the envelope separating and staging machine 10, but also all of the machines and components that make up the overall high speed document processing apparatus, of which the machine 10 is just one component. However, again it should be understood that only so much of the microprocessor is described as is necessary to an understanding of the invention. Also, the lines shown on the diagram of FIG. 4 are merely representative of the operative interconnections between the various components of the control system.

The initial step of operation is to cycle the machine 10 through a pre-feed setup procedure in which envelopes are fed successively from the supply hopper 40 through the envelope feed path until there is an envelope at each of the staging locations designated E1, E2 and E3.

When the document processing apparatus is put into operation, the microprocessor causes the chain 24 to commence movement from left to right as viewed in FIG. 2, and the pushers 22 push a collation 20 toward the insert location 25. At an appropriate moment, the microprocessor 150 sends a demand signal via the line 154 to the clutch/brake assembly 134 to engage the clutch component so as to cause the feed rollers 102 and back up rollers 106 to feed the envelope E3 from the third staging location to the insert position 25 to replace the previous envelope. When the envelope E3 reaches the insert location 25, the pushers 22 insert the collation 20 into the envelope in known manner, and the microprocessor 150 then causes the envelope stops 26 to depress out of the insert material path defined by the frame member 18 to permit the envelope with the collation 20 therein to move out of the insert location. For the purpose of facilitating explanation of operation of the machine 10, the movement of the envelope E3 will be assumed to be the beginning of a cycle of operation. It should be understood that the timing of the signal from the microprocessor 150 to the clutch/brake assembly 134 is controlled so as to place an envelope in the insert location 25 prior to arrival of a collation 20 at the insert location.

Figure 3:
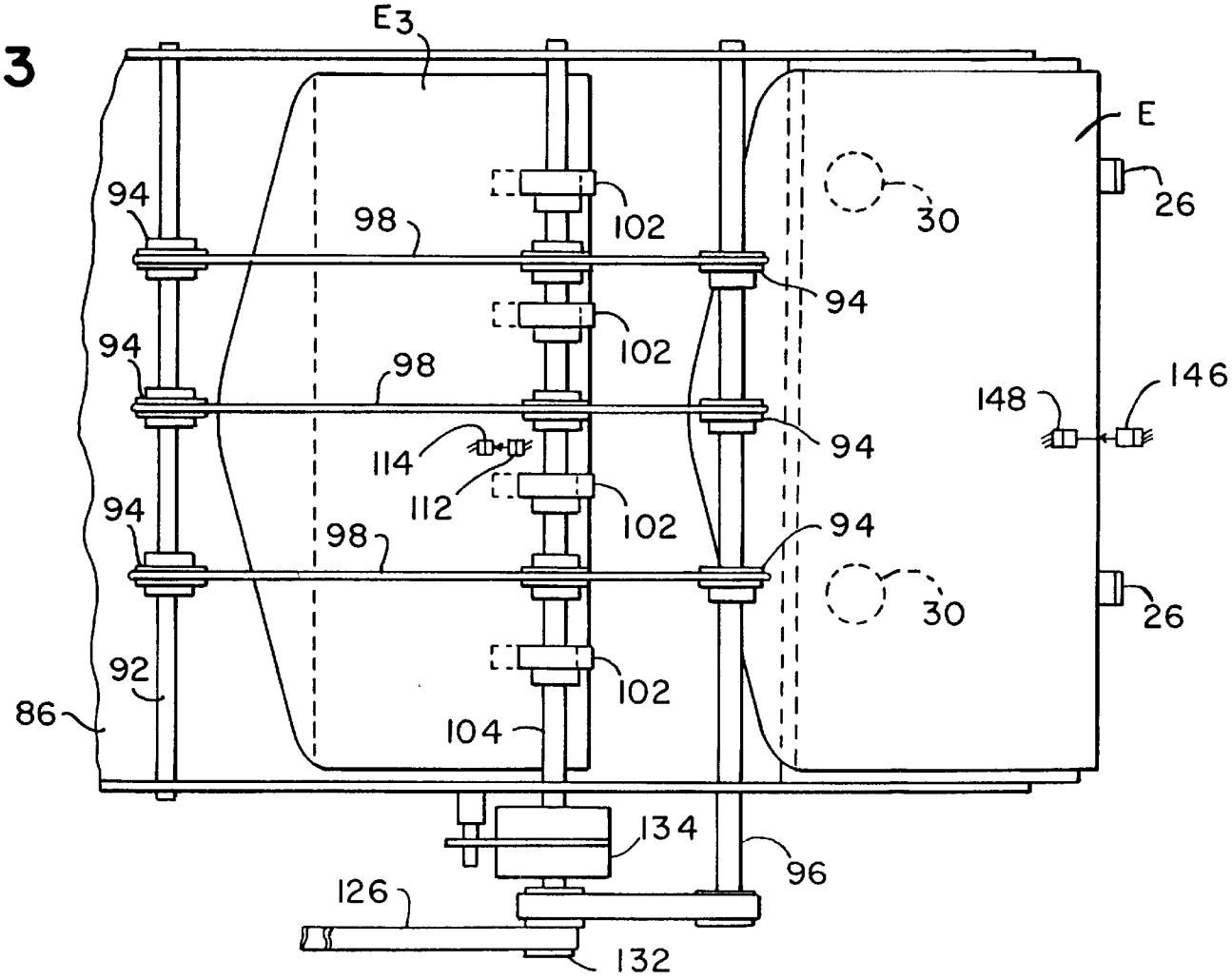
FIG. 3 is a fragmentary plan view of the apparatus shown in FIG. 2 looking along the line 3—3 of FIG. 2.

As seen in FIGS. 2 and 3, when the trailing edge of the envelope E3 is sensed by the detector 112/114, a signal is sent via the line 156 to the microprocessor 150 indicating that the envelope E3 is substantially out of the third staging location, and the microprocessor 150 then sends a signal via the line 158 to the clutch/brake assembly 124 to engage the clutch component to cause the feed roller 68 and backup rollers 78 to feed the envelope E2 from the second staging location to the third staging location and to transfer control of movement of the envelope E2 from the feed roller 68 to the belts 98 and the feed rollers 102, which are still turning. When the lead edge of the envelope E2 is sensed by the detector 112/114, a signal is sent via the line 160 to a suitable encoder, designated generally by the reference numeral 152 and which in practice is an integral part of the microprocessor 150 but which is shown separately for convenience of illustration and explanation, and the encoder 152 then counts a predetermined variable number of pulses. When the appropriate count has been reached, the encoder sends a signal via the line 162 to the microprocessor 150 which in turn sends a signal via the line 164 to the clutch/brake assembly 134, which disengages the clutch component and applies the brake component, thereby stopping the rotation of the rollers 102 and 106, and the belts 98, to stop the envelope E2 in the third staging location, so that the envelope E2 is now in the position formerly occupied by the envelope E3.

Concurrently with the movement of the envelope E2 from the second staging location to the third staging location, when the detector 83/85 senses the trailing edge of the envelope E2 as it leaves the second staging location, the detector sends a signal via the line 166 to the microprocessor that the envelope E2 is substantially out of the second staging location, and the microprocessor then sends a signal via the line 168 to the clutch/brake assembly 130 to engage the clutch component to cause the feed rollers 56 and the backup rollers 60 to feed the envelope E1 from the first staging location to the second staging location, and to transfer control of movement of the envelope E1 from the feed rollers 56 to the feed roller 68, which is still turning. When the lead edge of the envelope E1 is sensed by the detector 83/85, it sends a signal via the line 170 to the encoder 152, which commences an appropriate pulse count for the envelope E1, and when the count is reached, the encoder sends a signal via the line 172 to the microprocessor 150 which in turn sends a signal via the line 158 to the clutch/brake assembly 124 which disengages the clutch component and applies the brake component, thereby stopping the rotation of the rollers 68 and 78 to stop the envelope E1 in the second staging location, so that the envelope E1 is now in the position formerly occupied by the envelope E2.

Again, concurrently with the movement of the envelope E1 from the first staging location to the second staging location, when the detector 64/66 senses the trailing edge of the envelope E1 as it leaves the first staging location, the detector 64/66 sends a signal via the line 174 to the microprocessor that the envelope E1 is substantially out of the first staging location, and the microprocessor than sends a signal via the line 176 to the clutch/brake assembly 138 to engage the clutch component to cause the feed rollers 46 and backup rollers 50 to feed another envelope E from the supply hopper 40 to the first staging location, and to transfer control of movement of the new envelope E from the feed rollers 46 to the feed rollers 56, which are still running. And again, when the lead edge of the new envelope E is sensed by the detector 64/66, it sends a signal via the line 178 to the encoder 152, which commences an appropriate pulse count for the new envelope, and when the count is reached, the encoder sends a signal via the line 180 to the microprocessor 150 which in turn sends a signal via the line 168 to the clutch/brake assembly 130 which disengages the clutch component and applies the brake component, thereby stopping the rotation of the rollers 46 and 50 to stop the envelope E in the first staging location, so that the new envelope E is now in the position formerly occupied by the Envelope E1.

At this point, a cycle of operation of the machine 10 has been completed, since envelope E2 was moved from the second staging location to the third staging location to replace the envelope E3 that was moved on demand by the microprocessor to the insert location 25, the envelope E1 was moved from the first staging location to the second staging location to replace the envelope E2, and a new envelope E was moved from the supply hopper 40 to the first staging location to replace the envelope E1. The machine 10 now waits for the next demand signal from the microprocessor 150 to initiate the feeding of the succeeding envelope E3 from the third staging location to the insert location 25.

As seen in FIG. 2, there is a fourth detector 146/148 disposed immediately adjacent to the envelope stop member 26, the purpose of which is to detect the arrival of the lead edge of the envelope E3 at the stop members 26. In operation, if for any reason the envelope E3 does not move, or becomes jammed, and the lead edge thereof does not arrive at the stop members 26 in time for the throat E' to be opened, the detector 146/148 will sense this and send a signal to the microprocessor which puts the entire document processing apparatus into a hold mode, so that the problem with the envelop E3 can be resolved and normal operation of the apparatus resumed.

It is to be understood that the present invention is not to be considered as limited to the specific embodiment described above and shown in the accompanying drawings, which is merely illustrative of the best mode presently contemplated for carrying out the invention and which is susceptible to such changes as may be obvious to one skilled in the art, but rather that the invention is intended to cover all such variations, modifications and equivalents thereof as may be deemed to be within the scope of the claims appended hereto.

We claim:

1. An envelope separating and staging machine for use in high speed document processing apparatus in which a succession of collations of insert material moving along an insert material feed path to an insert location are inserted into envelopes fed to the insert location, said envelope separating and staging machine comprising A. envelope storing and separating means disposed in spaced operative relationship with the insert location of the inserting apparatus, B. means defining an envelope feed path extending from said storing and separating means to said insert location, said envelope feed path being of sufficient length between said storing and separating means and said insert location to provide a plurality of closely spaced apart envelope staging locations, C. means for intermittently feeding envelopes successively through said staging locations along said envelope feed path and for temporarily holding a single envelope at each of said plurality of staging locations, and D. control means for controlling the operation of said storing and separating means and said feeding means for moving said envelopes through said plurality of staging locations along feed path and to said insert location in timed synchronism with the arrival of said collations of insert material at said insert location, whereby the distance between successive envelopes moving through said plurality of staging locations along said feed path to said insert location is approximately equal to the distance between successive collations moving along the insert material feed path, thereby increasing the rate at which envelopes can be fed to said insert location.

2. An envelope separating and staging machine as set forth in claim 1 wherein said means for feeding envelopes successively through said staging locations and for temporarily holding an envelope at each of said staging locations comprises a plurality of individual feeding assemblies disposed in spaced apart relationship along said envelope feed path and defining said staging locations between adjacent feeding assemblies.

3. An envelope separating and staging machine as set forth in claim 2 wherein said storing and separating means and said individual feeding assemblies include moving and arresting means for successively intermittently moving said envelopes from said storing and separating means and along said feed path, and for arresting the movement of said envelopes at said staging locations.

4. An envelope separating and staging machine as set forth in claim 1 wherein said control means comprises detecting means disposed in each of staging locations for detecting the presence of the trailing edges of envelopes moving out of each of said staging locations for causing said feeding means to feed an envelope from a preceding staging location to a succeeding staging location when the envelope in said succeeding staging location has been moved substantially out of said succeeding staging location.

5. An envelope separating and staging machine as set forth in claim 4 wherein said detecting means further detects the presence of the leading edges of envelopes moving into each of said staging locations for controlling the position in each of said staging locations at which said envelopes come to rest.

6. An envelope separating and staging machine as set forth in claim 5 wherein said control means further includes means responsive to signals from said detecting means for actuating said feeding means to cause said feeding means to feed envelopes from one staging location to the next in response to said detecting means detecting said trailing edges of said envelopes, and for causing said feeding means to stop the movement of said envelopes in said staging locations in response to said detecting means detecting said leading edges of said envelopes.

7. An envelope separating and staging machine set forth in claim 6 wherein A. said separating and staging machine includes continuously operating drive means for said storing and separating means and for said individual feeding assemblies, and B said storing and separating means and said moving and arresting means includes means interposed between said continuously operating drive means and said storing and separating means and said individual feeding assemblies, said means being selectively operable to connect and disconnect said storing and separating means and said individual feeding assemblies to and from said continuously operating drive means.

8. An envelope separating and staging machine as set forth in claim 7 wherein said selectively operable means for intermittently connecting and disconnecting said storing and separating means and said individual feeding assemblies to and from said continuously operating drive means comprises a clutch/brake assembly interposed between said drive means and each of said storing and separating means and said individual feeding assemblies and operable to respectively engage said storing and separating means and each of said individual feeding assemblies with said continuously operating drive means, or to disengage said storing and separating means and said individual feeding assemblies from said continuously operating drive means and apply a braking force thereto.

9. An envelope separating and staging machine as set forth in claim 8 wherein said control means comprises detecting means disposed in each of staging locations for detecting the presence of the trailing edges of envelopes moving out of each of said staging locations for causing said storing and separating means and said individual feeding assemblies to feed an envelope from said storing and separating means, or a preceding staging location, to a succeeding staging location, when the envelope in said succeeding staging location has been moved substantially out of said succeeding staging location.

10. An envelope separating and staging machine as set forth in claim 9 wherein said control means further includes means responsive to signals from said detecting means for actuating said storing and separating means and said individual feeding assemblies to cause said storing and separating means and said individual feeding assemblies to feed envelopes from said storing and separating means to the first of said staging locations and from one staging location to the next in response to said detecting means detecting said trailing edges of said envelopes, and for causing said individual feeding assemblies to stop the movement of said envelopes in said staging locations in response to said detecting means detecting said leading edges of said envelopes.

* * * * *